US007258414B2

(12) United States Patent
Satoh

(10) Patent No.: US 7,258,414 B2
(45) Date of Patent: Aug. 21, 2007

(54) IMAGE-FORMING APPARATUS

(75) Inventor: Masaki Satoh, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 25 days.

(21) Appl. No.: 11/229,299

(22) Filed: Sep. 16, 2005

(65) Prior Publication Data

US 2006/0061612 A1 Mar. 23, 2006

(30) Foreign Application Priority Data

Sep. 17, 2004 (JP) ..... 2004-272556
Mar. 8, 2005 (JP) ..... 2005-064143
Apr. 15, 2005 (JP) ..... 2005-118638

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 4,943,166 A * 7/1990 Yamashita ..... 369/30.03
4,952,874 A * 8/1990 Stadtfeld ..... 324/207.22
5,010,489 A * 4/1991 Masaki et al. ..... 701/79
5,376,106 A * 12/1994 Stahmann et al. ..... 607/18
5,852,592 A * 12/1998 Braat ..... 369/44.35
6,397,018 B1 * 5/2002 Matsumoto et al. ..... 399/27
7,076,195 B2 * 7/2006 Sakai ..... 399/301
2003/0035020 A1 * 2/2003 Menendez et al. ..... 347/37
2003/0151775 A1 * 8/2003 Wang et al. ..... 358/300
2004/0227067 A1 * 11/2004 Rodi ..... 250/231.14
2005/0105937 A1 * 5/2005 Sakai ..... 399/301

FOREIGN PATENT DOCUMENTS

JP 08152917 A * 6/1996
JP 2001051490 A * 2/2001
JP 2002-091264 3/2002
JP 2002-238274 8/2002
JP 2002-357994 12/2002

* cited by examiner

*Primary Examiner*—Lamson Nguyen
*Assistant Examiner*—Justin Seo
(74) *Attorney, Agent, or Firm*—Blakely, Sokoloff, Taylor & Zafman LLP

(57) ABSTRACT

An image-forming apparatus is disclosed. The apparatus includes a paper-carrying belt for carrying paper, drive unit for driving the paper-carrying belt, a scale provided on the paper-carrying belt that indicates position information and that partially has a scale seam portion, position-detection unit for reading the position information from the scale, and control unit for generating position information from an output of the position-detection means and controlling the drive means based on the position information in order to drive and control the paper-carrying belt.

A first sensor and a second sensor for reading the position information from the scale are provided as the position-detection means, and the first sensor and the second sensor are provided in order to be separated by a distance which is more than or equal to a gap width of the scale seam.

The control is configured to use as position information what is combined after putting weightings on a first sensor output which is output from the first sensor and a second sensor output which is output from the second sensor.

6 Claims, 11 Drawing Sheets

IMAGE-FORMING APPARATUS

The present document incorporates by reference and claims priority to the entire contents of Japanese priority documents, 2004-272556 filed in Japan on Sep. 17, 2004 and 2005-064143 filed in Japan on Mar. 8, 2005 and 2005-118638 filed on Apr. 15, 2005.

BACKGROUND OF THE INVENTION

For an inkjet-type image-forming apparatus, a highly-accurate position control is generally required in driving paper-carrying in order to obtain a high-quality image. Here, as it is preferable to be able to directly observe the motion of a paper-carrying belt to be position controlled, it is possible to directly mark on the paper-carrying belt and detect the mark (see JP 2002-238274A). Moreover, a method of affixing a linear scale on the front or back face of the paper-carrying belt is known as a way of actually providing the mark.

FIG. 1 illustrates an image-forming apparatus in which a linear scale is provided on a paper-carrying belt. The illustrated image-forming apparatus 1 is set to be a mechanism such that a motor 3 driving via a decelerating mechanism a drive roller 4 installed causes a paper-carrying belt 2 provided between the drive roller 4 and a follower roller 5 to be rotated and paper (not illustrated) to be carried. In this carrying process, printing (image forming) is performed on the paper by use of an inkjet (IJ) carriage 6.

A linear scale 7 is provided on the inner side of the paper-carrying belt 2 over one round of the belt for measuring the belt position. Moreover, one sensor 8 for reading this linear scale 7 is provided at a position opposite the linear scale 7.

This sensor 8 is connected to a detection apparatus 102 in which the number of sinusoidal peaks (the number of pulses) generated in correspondence with the movement of the paper-carrying belt 2 is counted based on the sensor output sent from the sensor 8. The count value in correspondence with the movement of the paper-carrying belt 2 is sent to a control apparatus 103 which controls, based on the count value, a drive apparatus 104 for driving and controlling the motor 3. Hereby, the moving speed of the paper-carrying belt 2 is controlled by a predetermined speed, thus making it possible to form a high-quality image.

However, circumferentially affixing a scale onto the paper-carrying belt 2 inevitably results in the scale crossing a seam portion. Thus, at the seam portion, the scale interval (the phase) of the linear scale 7 is caused to be discontinuous and also the sensor output from the sensor 8 is caused to be a discontinuous signal.

In other words, even when the paper-carrying belt 2 is moving at a constant speed, the sensor output from the sensor 8 is caused to be discontinuous, resulting in not being able to obtain correct position information. The stopping of the flow of information necessary for position control in the seam portion results in a problem of not being able to form highly-accurate images on paper.

SUMMARY OF THE INVENTION

An image-forming apparatus is described. In one embodiment, the image-forming apparatus comprises a paper-carrying belt to carry paper, a drive unit to drive the paper-carrying belt, a scale provided on the paper-carrying belt that indicates position information and that includes a scale seam, a position-detection unit to read the position information from the scale, and a control unit to generate position information from an output of the position-detection unit and control the drive unit based on the position information in order to to drive and control the paper-carrying belt, wherein the position detection unit comprises a first sensor and a second sensor for reading the position information from the scale unit, and the first sensor and the second sensor separated by a distance which is more than or equal to a gap width of the scale seam, and wherein the control unit is operable to use as position information what is combined after putting weightings on a first sensor output which is output from the first sensor and a second sensor output which is output from the second sensor.

BRIEF DESCRIPTION OF THE DRAWINGS

Other features of the present invention will become more apparent from the following detailed description when read in conjunction with the accompanying drawings, in which.

DETAILED DESCRIPTION

Embodiments of the present invention generally relate to a technology for image forming and more specifically relates to an image-forming apparatus for controlling paper-carrying using a scale provided on a paper-carrying belt.

Accordingly, one embodiment of the present invention includes a technology for image forming that substantially obviates one or more problems caused by the limitations and disadvantages discussed above.

According to one embodiment of the present invention, an image-forming apparatus is provided for controlling paper-carrying using a scale provided on a paper-carrying belt that drives and controls with high accuracy the paper-carrying belt and that improves on the image-forming accuracy.

According to another embodiment of the invention, an image-forming apparatus includes a paper-carrying belt for carrying paper, a drive unit for driving the paper-carrying belt, a scale provided on the paper-carrying belt that indicates position information and that includes a scale seam, a position-detection unit for reading the position information from the scale, and a control unit for generating position information from an output of the position-detection means and controlling the drive means based on the position information in order to drive and control the paper-carrying belt, wherein the position detection unit comprises a first sensor and a second sensor for reading the position information from the scale, and the first sensor and the second sensor are separated by a distance which is more than or equal to a gap width of the scale seam, and wherein the control means is configured to use as position information what is combined after putting weightings on a first sensor output which is output from the first sensor and a second sensor output which is output from the second sensor.

The image-forming apparatus in an embodiment of the invention makes it possible to drive and control with high accuracy the paper-carrying belt and to improve on the image-forming accuracy Descriptions are given next, with reference to the accompanying drawings, of a preferred embodiment of the present invention.

Figure 1:
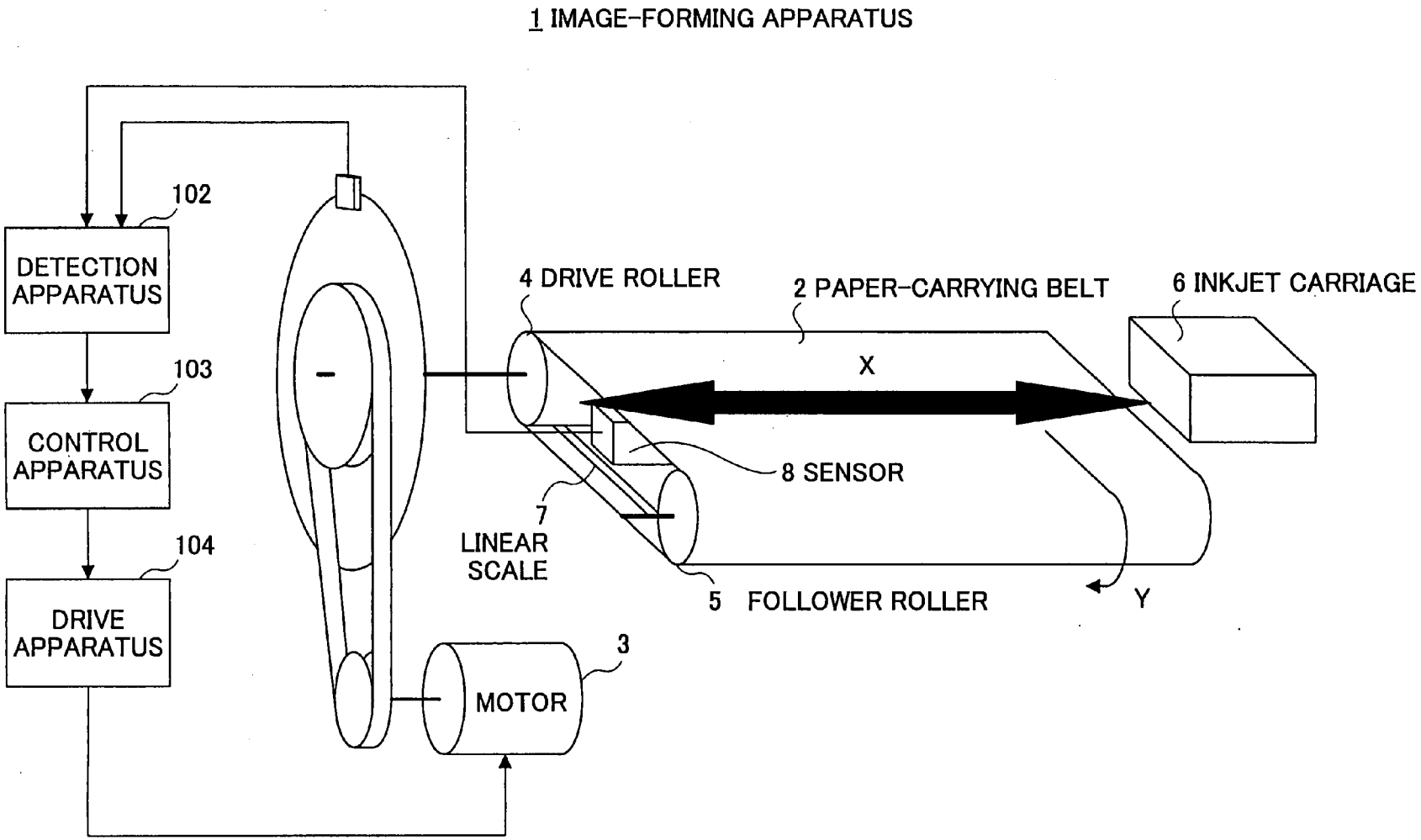
FIG. 1 is a block diagram illustrating one example of an image-forming apparatus.
Figure 2:
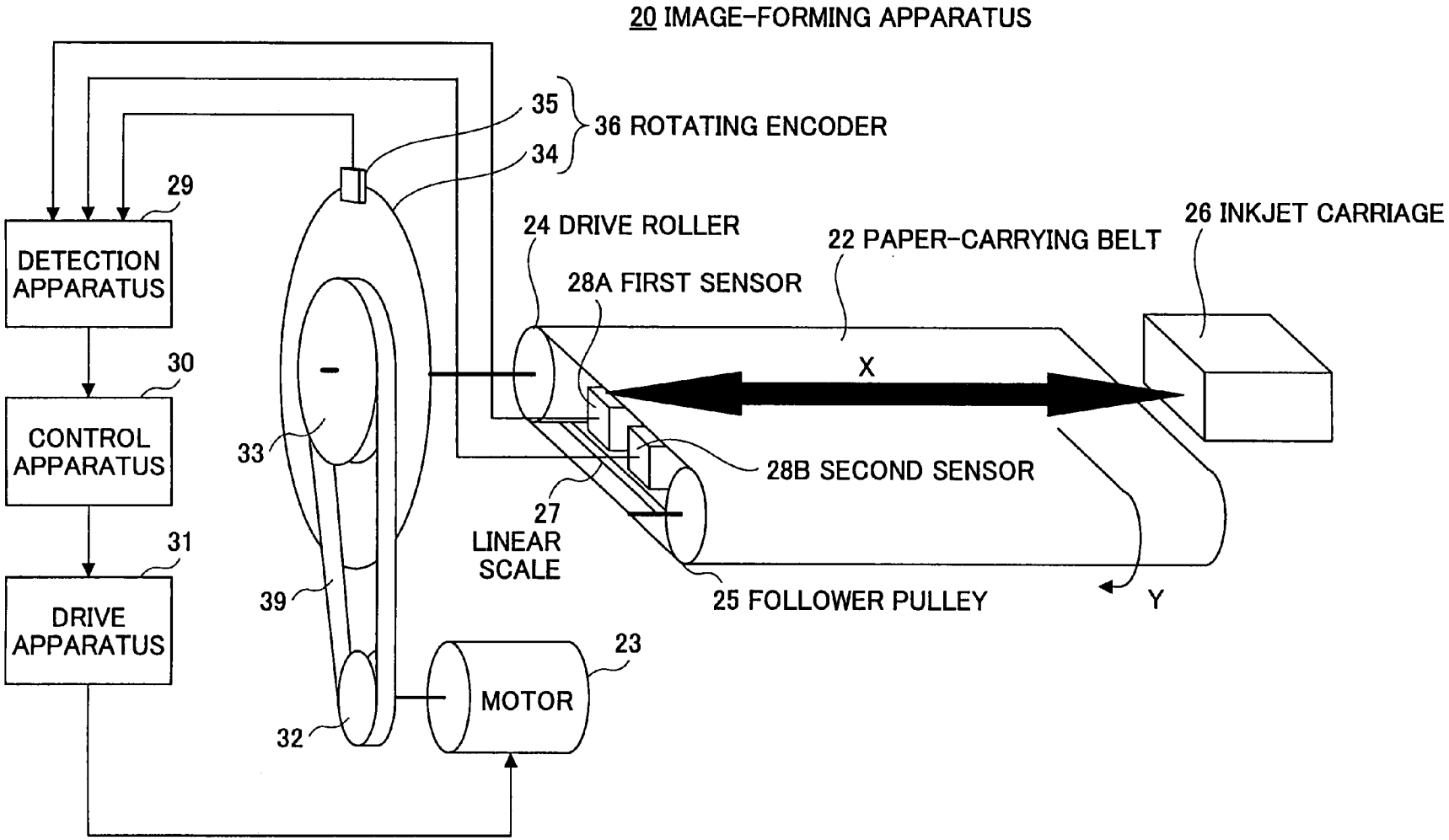
FIG. 2 is a block diagram of one embodiment of an image-forming apparatus.

FIG. 2 is a block diagram of an image-forming apparatus 20 which is one embodiment of the invention. The illustrated image-forming apparatus 20 is a mechanism for driving a drive roller 24 by a motor 23, thereby causing a paper-carrying belt 22 that is between the drive roller 24 and a follower roller 25 to be rotated, and paper (not illustrated) placed on the paper-carrying belt 22 to be carried.

The motor 23 includes a pulley 32 while the drive roller 24 includes a pulley 33. A belt 39 is run between and around the pulley 32 and pulley 33. Thus, the rotational speed of the motor 23 is reduced by a reduction mechanism formed with the pulleys 32 and 33 and the belt 39 before being passed on to the drive roller 24.

Moreover, the pulley 33 has a rotating encoder 36 consisting of a rotating slit 34 and an optical sensor 35. The rotating slit 34 is provided coaxially with the pulley 33 and has also radially formed thereon a number of equally-wide and equally-spaced slits. The optical sensor 35, a photointerpreter, is located at a position opposite the slits. The optical sensor 35 detecting light passing through the slits causes a pulse signal to be generated. This pulse signal corresponds to the rotation of the motor 23 so that the driving state of the motor 23 can be determined with a signal from the rotating encoder 36. This rotating encoder 36 is connected to a detection apparatus 29.

An inkjet carriage 26 is configured to be movable in the arrow X directions on the upper face of the paper-carrying belt 22 (in other words, on paper). Then, in the process such that paper is carried in the Y direction by the paper-carrying belt 22, the inkjet carriage 26 moves in the X directions and performs printing (image forming) on the paper in the process. Driving and controlling the inkjet carriage 26 as well as driving and controlling the paper-crying belt 22 are important in performing high-quality printing (image forming) on this paper.

Figure 7A:
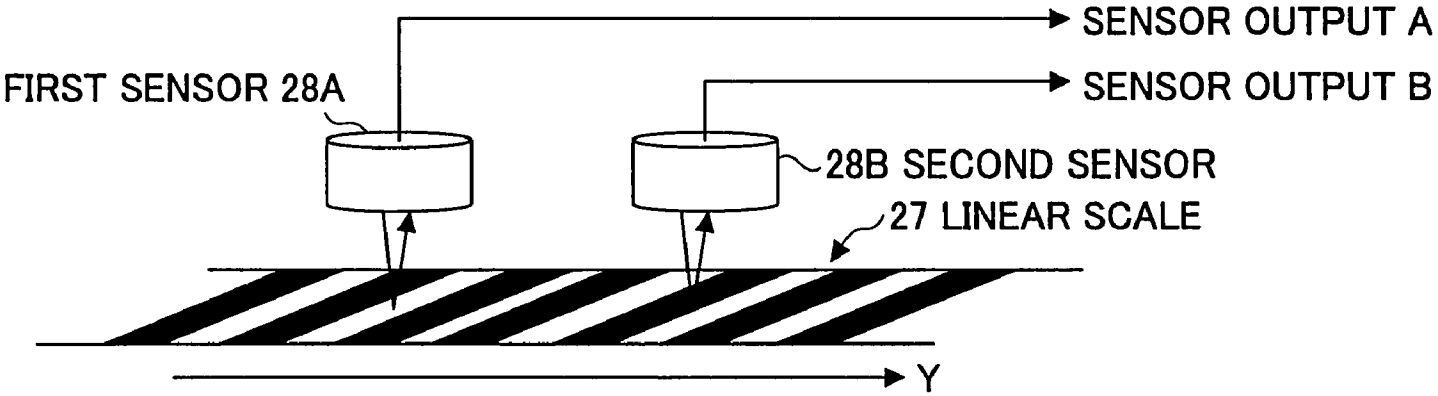
FIG. 7A is a diagram illustrating on an enlarged scale a linear scale and sensors at a continuous portion of the linear scale.
Figure 7B:
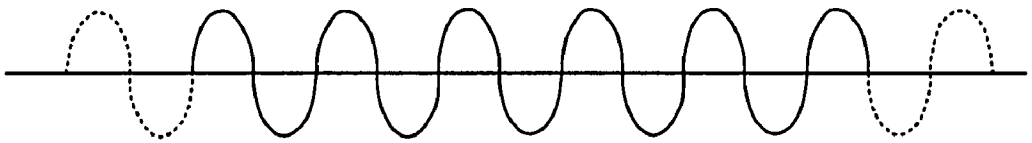
FIG. 7B is a diagram illustrating the phase of the linear scale at the continuous portion of the scale.
Figure 8A:
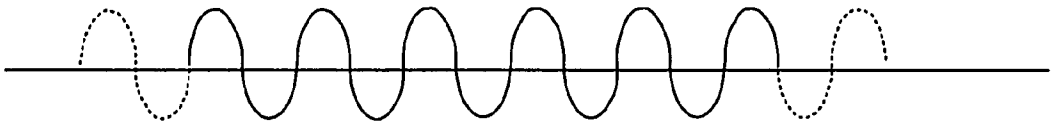
FIG. 8A is a portion of a first diagram for describing the process of switching the sensor output from a first sensor to a second sensor.
Figure 8B:
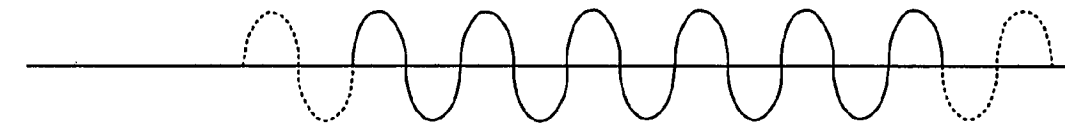
FIG. 8B is another portion of the first diagram for describing the process of switching the sensor output from the first sensor to the second sensor.

On the inner side of the paper-carrying belt 22, over one round of the belt, a linear scale 27 for measuring the belt position. The linear scale 27 in the present embodiment is configured such that, as illustrated on an enlarged scale in FIGS. 3A and 7A, a light-reflecting portion (illustrated in white) and a light-absorbing portion (illustrated in black) are alternatingly formed on a regular basis (below described as a position-detection pattern). However, as described previously, circumferentially affixing the linear scale 27 onto the paper-carrying belt 22 inevitably causes a scale seam 37 to be crossed.

At a position opposite this linear scale 27 is provided a position-detection unit for reading the position-detection pattern formed on the linear scale 27. In the present embodiment, this position-detection unit is characterized by having two sensors, a first sensor 28A and a second sensor 28B. The first sensor 28A and the second sensor 28B are provided either at a position opposite the front face or at a position opposite the back face of the paper-carrying belt 22 on which the inkjet carriage 26 passes (in the present embodiment, they are arranged at the position opposite the back face of the paper-carrying belt 22). Hereby, each sensor 28A and 28B is arranged in the vicinity of the position at which the inkjet carriage 26 performs image forming (printing), making it possible to perform a highly-accurate detection process with a small error.

Moreover, the first sensor 28A and the second sensor 28B are positioned such that they are separated by a distance which is more than or equal to a gap width at the scale seam 37. While in the present embodiment the first sensor 28A and the second sensor 28B are configured to be fixed and separated by a given interval, a mechanism for adjusting the separating distance may be provided in order to make it possible to adjust the distance separating the first sensor 28A and the second sensor 28B. With the latter configuration, having the function of adjusting the inter-sensor distance makes it possible to easily adjust the sensor outputs from each sensor 28A and 28B to the same phase.

The first and second sensors 28A and 28B are connected to the detection apparatus 29 in which sinusoidal waveforms generated in correspondence with the movement of paper-carrying belt 22 are detected based on a first sensor output sent from the first sensor 28A and a second sensor output sent from the second sensor 28B.

As the sinusoidal waves detected with this detection apparatus 29 correspond with the movement of the paper-carrying belt 22, counting the number of peaks (the number of pulses) results in detecting from the count value the position of the paper-carrying belt 22. In this case, the present embodiment is configured to count after multiplying the number of sinusoidal pulses. A drive apparatus 31 for driving and controlling the motor 23 is controlled by a control apparatus 30.

Figure 11:
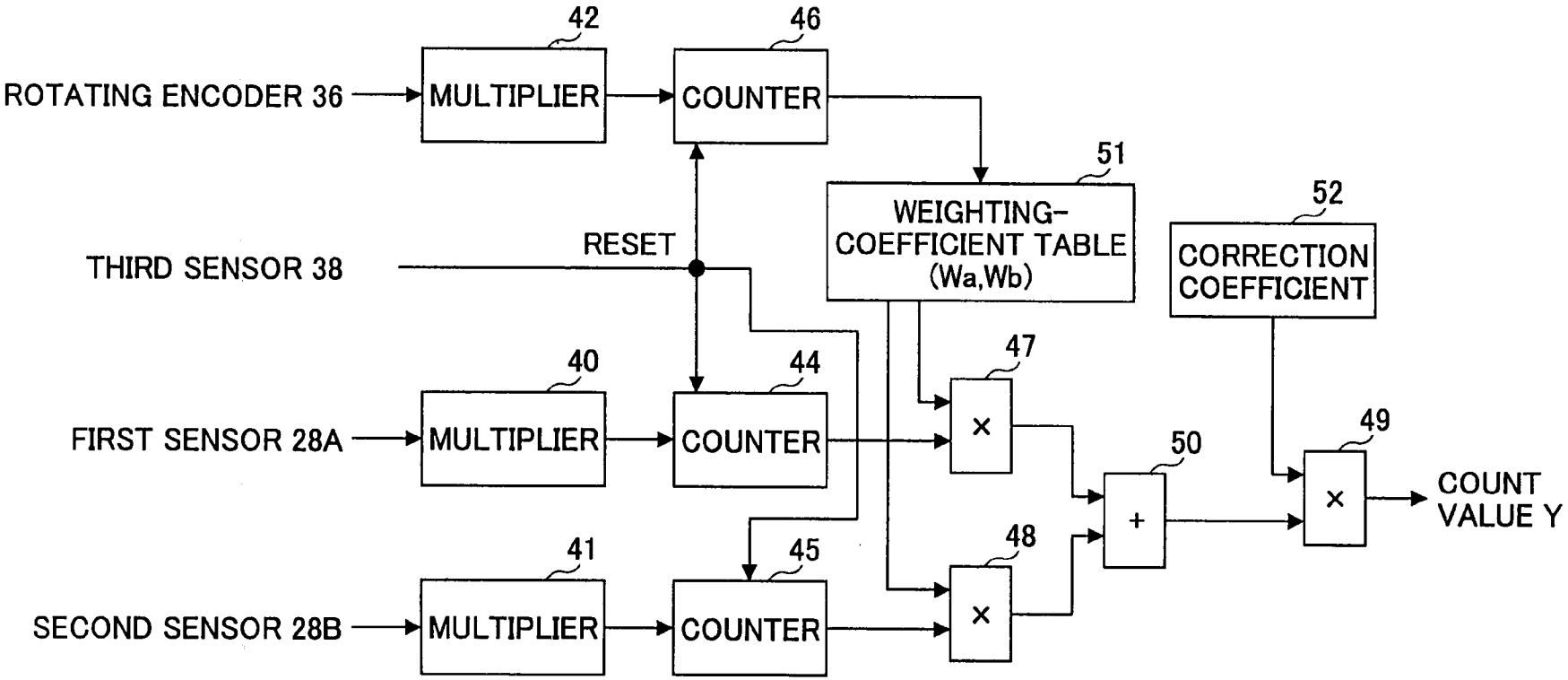
FIG. 11 is a block diagram of a detection apparatus (a signal-processing unit)

FIG. 11 is a block diagram illustrating the detection apparatus 29. The detection apparatus 29 consists of multipliers 40 through 42, counters 44 through 46, multipliers 47 and 48, an adder 50, a first corrector 51 and a second corrector 52, etc.

A sinusoidal pulse from the first sensor 28A is multiplied by the multiplier 40 before being supplied to the counter 44 and counted. Similarly, a sinusoidal pulse from the second sensor 28B is multiplied by the multiplier 41 before being supplied to the counter 45 and counted. Moreover, a pulse from the rotating encoder 36 is multiplied by the multiplier 42 before being supplied to the counter 46 and counted. Then, the count value of counter 46 is supplied to the first corrector 51 in which weighting coefficients are obtained with reference to a weighting table stored in advance based on the supplied count value.

Next, the process of weighting is performed on the outputs from the sensors 28A and 28B. More specifically, the multipliers 47 and 48 multiply the weighting coefficients obtained at the first corrector 51 by the count values sent from counters 44 and 45, respectively. The count values weighted at the multipliers 47 and 48 are sent to the adder 50. In this adder 50, the process is performed of combining the count value obtained from the sensor output of the first sensor 28A and the count value obtained from the sensor output of the second sensor 28B.

In this combining process, an instantaneous switching from the sensor 28A to the sensor 28B is performed when the scale seam 37 moves to a position between the first sensor 28A and the second sensor 28B. Various methods are possible for detecting this scale seam 37. For example, it may be possible by detecting a defect pulse P (to be described below) in the sensor output of the first sensor 28A illustrated in FIG. 3A or, it may be possible by configuring in such a manner as to provide, as illustrated in FIG. 11, separately from the sensors 28A and 28B a third sensor 38 for detecting the scale seam 37 and detect based on a signal from this third sensor 38. It is noted that providing a third sensor 38 dedicated to detecting the scale seam 37 makes it possible to detect with higher accuracy the passing of the scale seam 37.

The adder 50, based on the signal detected at the scale seam 37, weights on the count based on the first sensor output sent from the counter 44 and the count based on the first sensor output sent from the counter 45. In the multiplier 49, the correction process is performed by multiplying a correction coefficient (to be described below) which is obtained at the second corrector 52. The count value generated as described above (below called a count value Y) is sent to the control apparatus 30. Then, at the control apparatus 30, the motor 23 is driven and controlled based on the count value Y sent from the detection apparatus 29.

Next, more specific operations are described of the image-forming apparatus 20 as configured above.

Figure 3A:
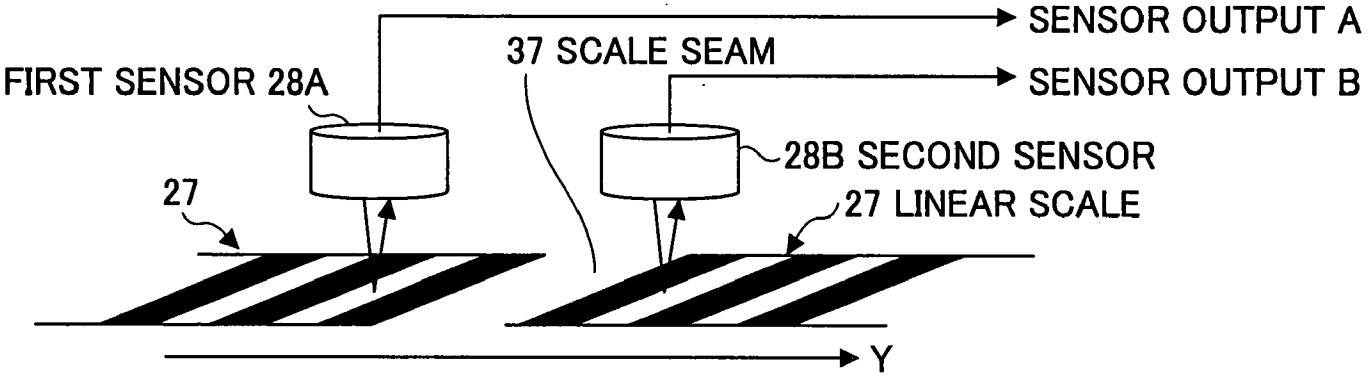
FIG. 3A is a diagram illustrating on an enlarged scale a linear scale and sensors at a scale seam.
Figure 3B:
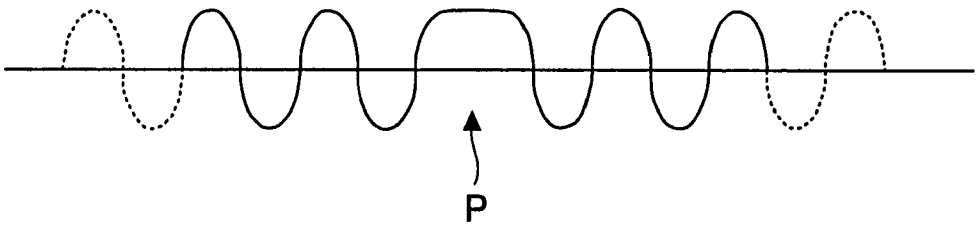
FIG. 3B is a diagram illustrating the phase of the linear scale at the scale seam.

FIGS. 3A and 3B show the state such that the scale seam 37 is situated between the first sensor 28A and the second sensor 28B. FIG. 3A illustrates the relative positions of the linear scale 27 and of each sensor 28A and 28B, while FIG. 3B illustrates the phase of the linear scale. It is noted that the paper-carrying belt 22 is carried in the arrow Y direction so that the linear scale 27 also moves in the illustrated arrow Y direction relative to each sensor 28A and 28B.

In the illustrated example, as the scale seam 37 has already passed the first sensor 28A, a defect pulse P which is different from a sinusoidal pulse is generated at the output of the first sensor 28A at a position corresponding to the scale seam 37. Thus, in case there is only one sensor provided which is the first sensor 28A, the sinusoidal waveform is caused to be discontinuous as in the prior art due to the defect pulse P, resulting in not being able to obtain correct position information on the paper-carrying belt 22.

Thus, in the present embodiment, computing in advance the count value Y with the sensor output from the second sensor 28B is the normal state. Then, with a configuration including the third sensor 38 (refer to FIG. 11), when the fact is detected that the scale seam 37 has moved to a position between the first and second sensors 28A and 28B with the paper-carrying belt 22 moving, while the scale seam 37 is between the first and second sensors 28A and 28B, the count value for sending to the multiplier 49 using the weighting-coefficient table 51, the multipliers 47 and 48, and the adder 50 is switched from one based on the second sensor 28B to one based on the first sensor 28A.

This combining process is performed in the weighting-coefficient table 51, the multipliers 47 and 48, and the adder 50 with a signal output from the third sensor 38 as a trigger. It is noted that it is also possible to set as a trigger a defect pulse P appearing as a sensor output of the first sensor 28A.

With the switching process, the count value Y output from the control apparatus 30 becomes a value which skips the scale seam 37, or in other words a value which is not affected by the scale seam 37. This is described using FIGS. 4 through 6.

Figure 4:
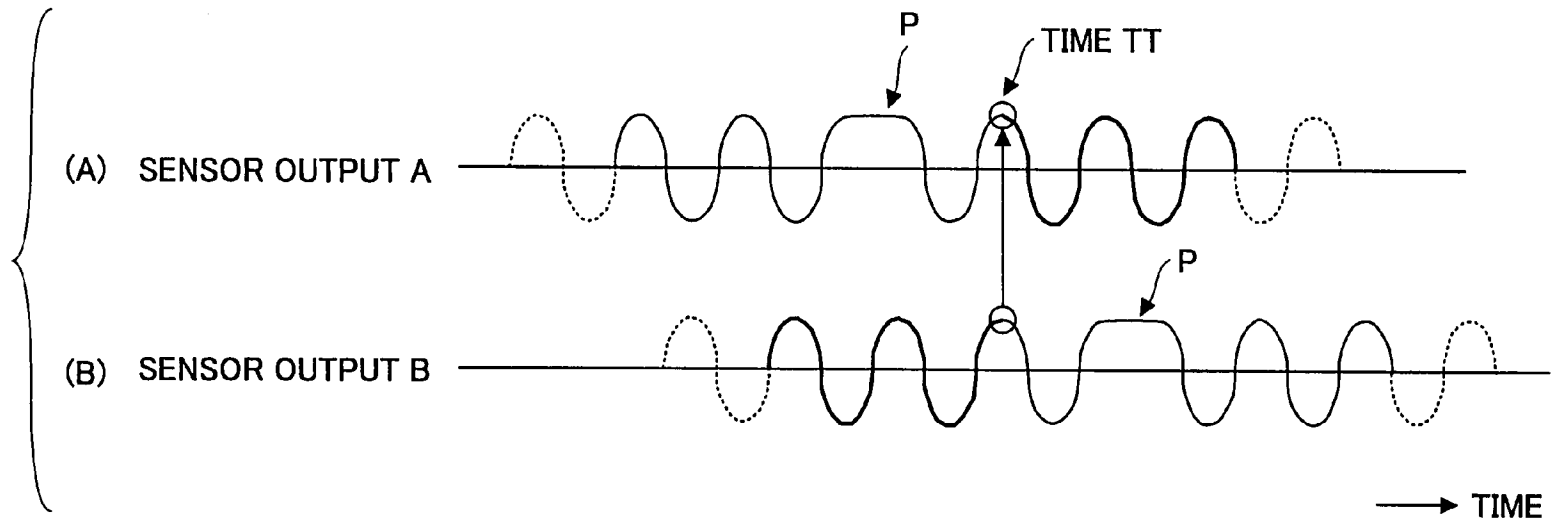
FIG. 4 is a first diagram for describing the process of switching the sensor output from a second sensor to a first sensor.
Figure 5:
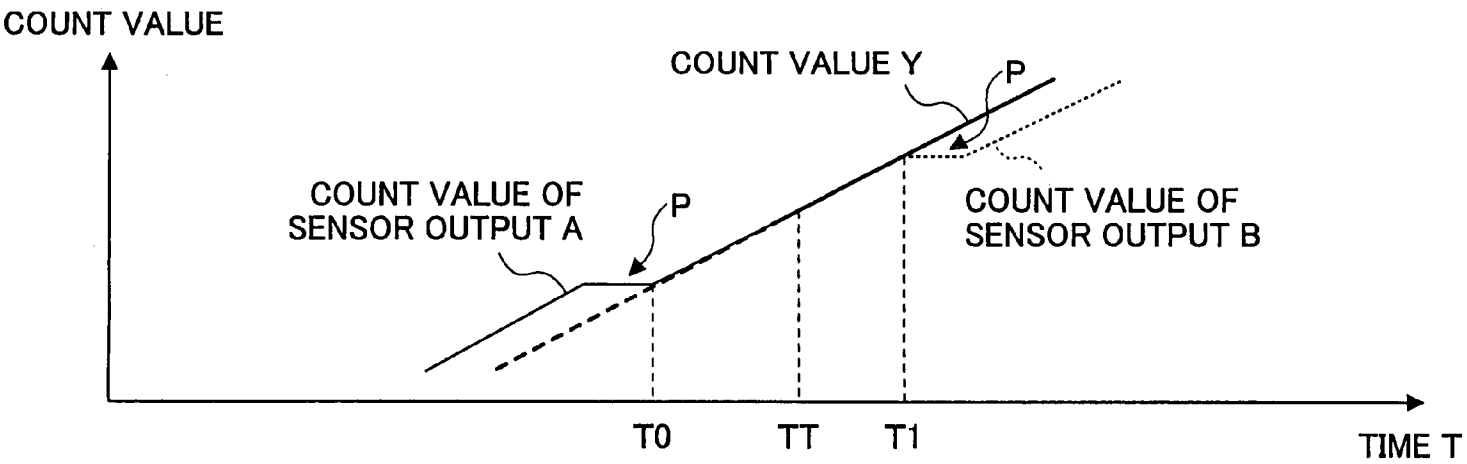
FIG. 5 is a second diagram for describing the process of switching the sensor output from the second sensor to the first sensor.

FIG. 4 illustrates in (A) the sensor output of the first sensor 28A (below called the sensor output A) and in (B) the sensor output of the second sensor 28B (below called the sensor output B). Moreover, FIG. 5 shows on the vertical axis the count values of the sensor output A and sensor output B that are counted at the counters 44 and 45, respectively, and time on the horizontal axis. Furthermore, for the convenience of explanation, in FIG. 6 the count values of the sensor output A and the sensor output B at the time of switching are separately illustrated. It is noted that in each of the figures as described above, the time of switching is set to be the time TT.

As illustrated in FIG. 4, when the scale seam 37 is situated between the first and second sensors 28A and 28B, a defect pulse P has already appeared in the sensor output A while a defect pulse P has yet to appear in the sensor output B. In this state, the image-forming apparatus 20 outputs the count value Y based on the sensor output B. However, as described previously, keeping as it is the state of outputting the count value Y based on the sensor output B causes a defect pulse P to appear at the sensor output B in order to make it not possible to accurately detect the position of the paper-caring belt 22.

Then as described previously, switching from the sensor output B to the sensor output A the sensor output (the count value) for sending to the multiplier 49 at the time TT (the time period during which the scale seam 37 is situated between the first and second sensors 28A and 28B) using the weighting-coefficient table 51, the multipliers 47 and 48, and the adder 50 causes, as illustrated in FIG. 4, a signal to be switched, before a defect pulse P appears at the sensor output B, to the sensor output A at which the defect pulse P has already appeared. In this case, the phase of the sensor output A and the phase of the sensor output B are set to be the same. Thus, the phase continuity after switching between sensors is maintained even when the switching occurs from the sensor output B to the sensor output A.

FIG. 5 illustrates the switching process as described above that is viewed as the relationship between time and the count values of the sensor output A and sensor output B. The count values are obtained by counting the number of peaks (pulses) of the sensor output A and sensor output B that are sinusoidal so that an introduction of the defect pulse P makes it not possible to compute the peaks (pulses) in the defect pulse P range, thus resulting in the count value being smaller than the normal count value.

As illustrated in FIG. 5, the characteristics becomes such that the count values of the sensor output A and sensor output B linearly increase with time except at the defect pulse P, while the characteristics become such as to have a concave bump at the decreasing side at the defect pulse P. Thus, during the period in which the scale seam 37 is situated in between the first and second sensors 28A and 28B (in other words, during the period between time T0 and time T1 in FIG. 5), the count value of the sensor output A and the count value of the sensor output B become close.

Figure 6:
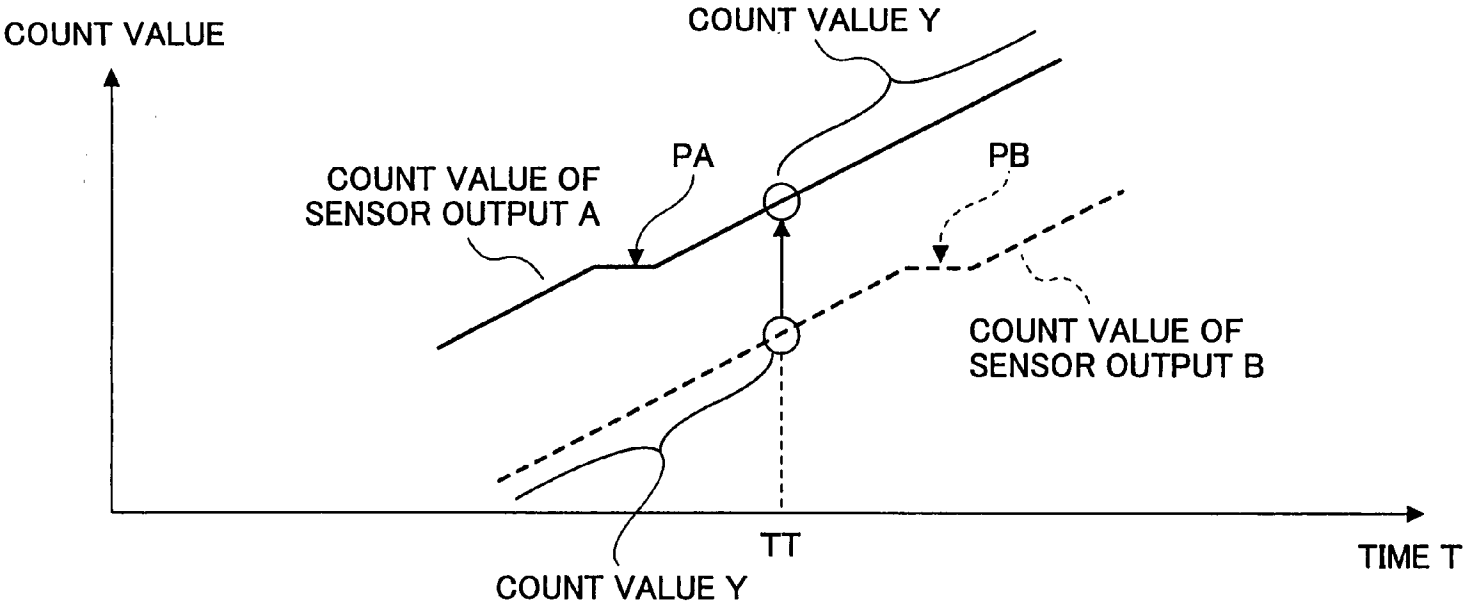
FIG. 6 is a third diagram for describing the process of switching the sensor output from the second sensor to the first sensor.

Thus, performing the switching process as described above at the time TT between the time T0 and the time T1 as illustrated in FIG. 6 causes the count value of the sensor output B to be used as the count value Y until the time TT and the count value of the sensor output A to be used as the count value Y at or after the time TT. Thereby, as illustrated in FIG. 5, a linear state is kept for the value of the count value Y in order to make it possible to detect with high accuracy over the whole circumference of the paper-carrying belt 22 the position of the paper-carrying belt 22 even when there is the scale seam 37 in the linear scale 27.

However, as the paper-carrying belt 22 is cylindrically-shaped, the paper-carrying belt 22 making a round causes the scale seam 37 to repeatedly appear between the sensor 28A and the sensor 28B. Thus, it is necessary to put the sensor output from the first sensor 28A back to the second sensor 28B before this scale seam appears again. Below a method is described of putting the sensor output from the first sensor 28A back to the second sensor 28B.

Figure 10:
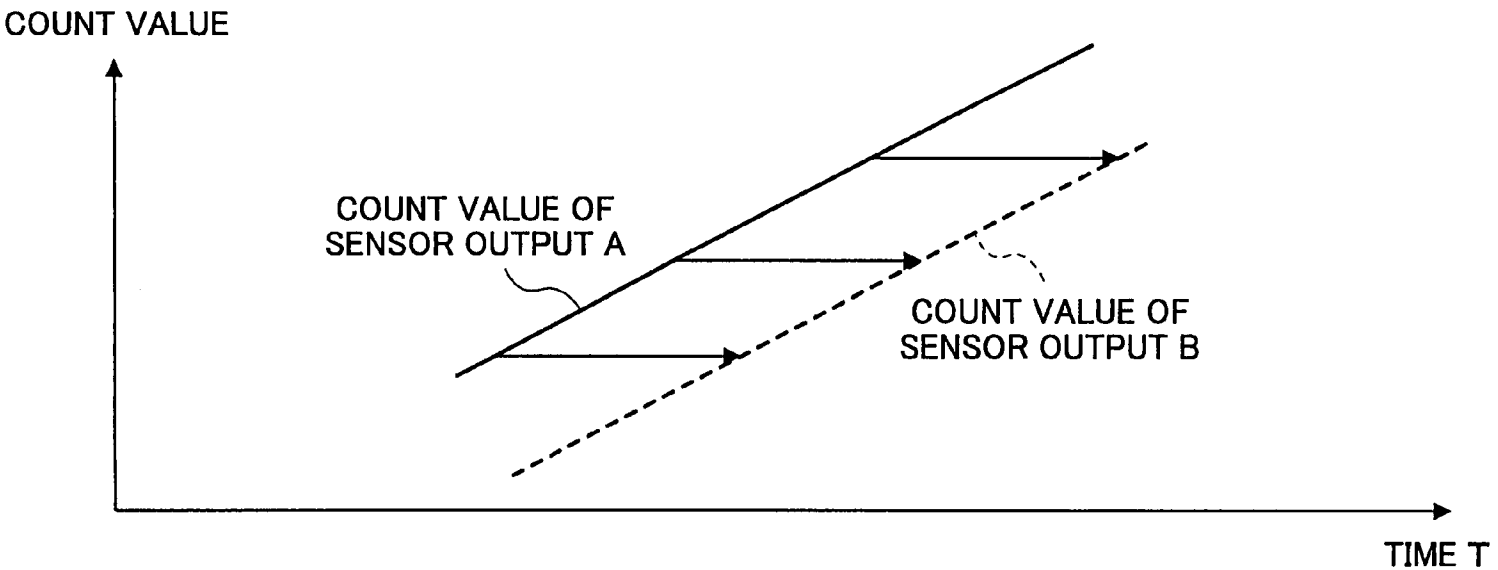
FIG. 10 is a third diagram for describing the process of switching the sensor output from the first sensor to the second sensor.

FIGS. 7A, 7B, 8A, and 8B illustrate a case such that there is not a scale seam 37 between the first sensor 28A and the second sensor 28B. In the present embodiment, as schematically illustrated in FIG. 10, the process is performed of putting the count value of the sensor output A back to the count value of the sensor output B when there is no scale seam 37 between the sensor 28A and the sensor 28B.

Figure 12:
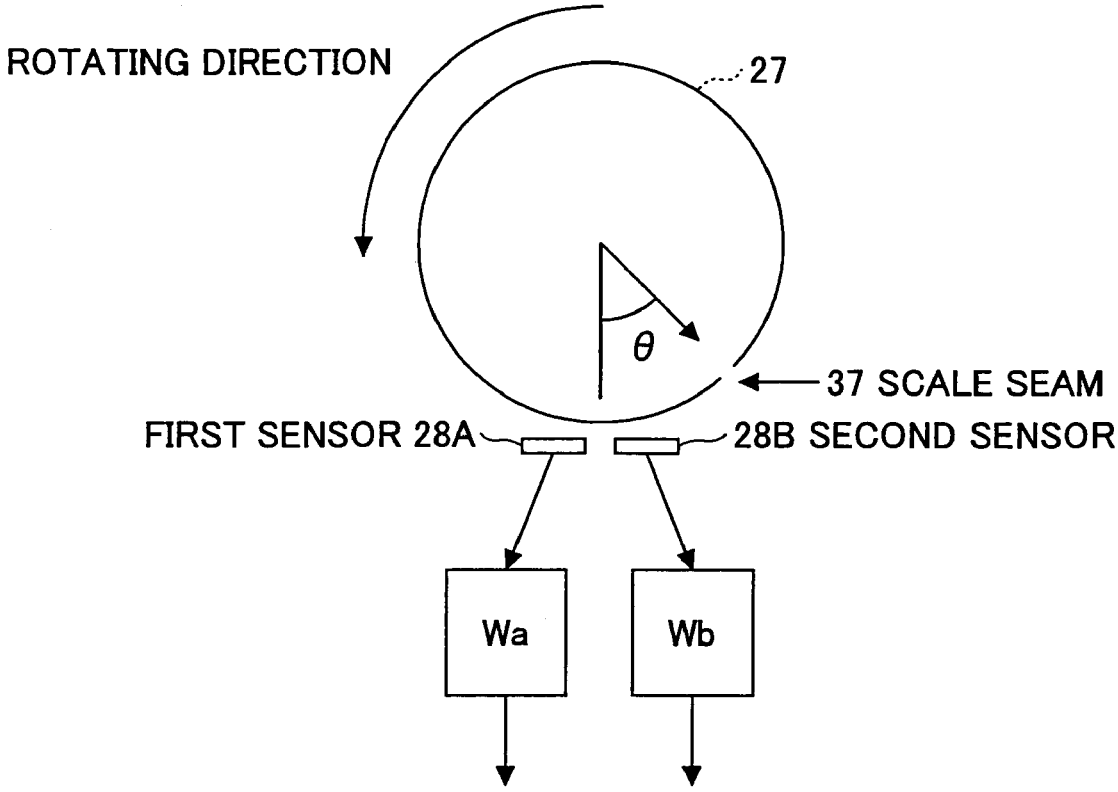
FIG. 12 is a block diagram for describing a specific method of changing the weightings on first and second sensor outputs in order to switch the sensor output from the first sensor to the second sensor.
Figure 13A:
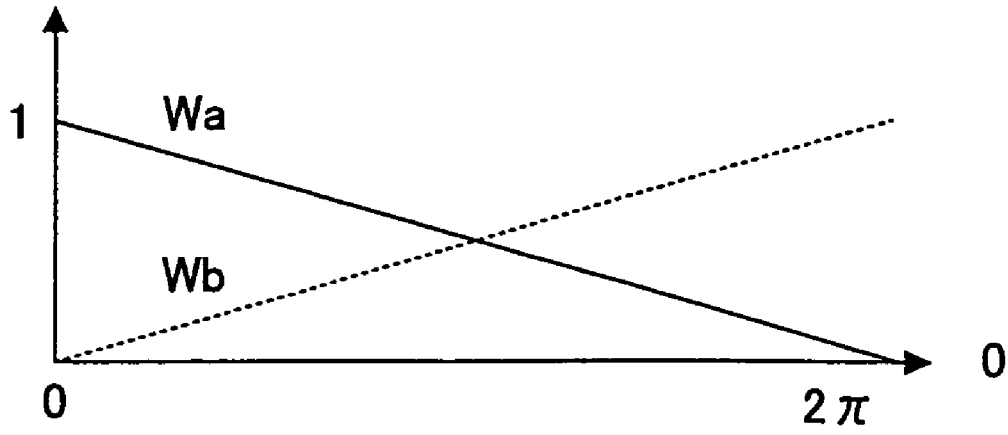
FIG. 13A is one diagram illustrating a change in the weightings on the first and second sensor outputs.
Figure 13B:
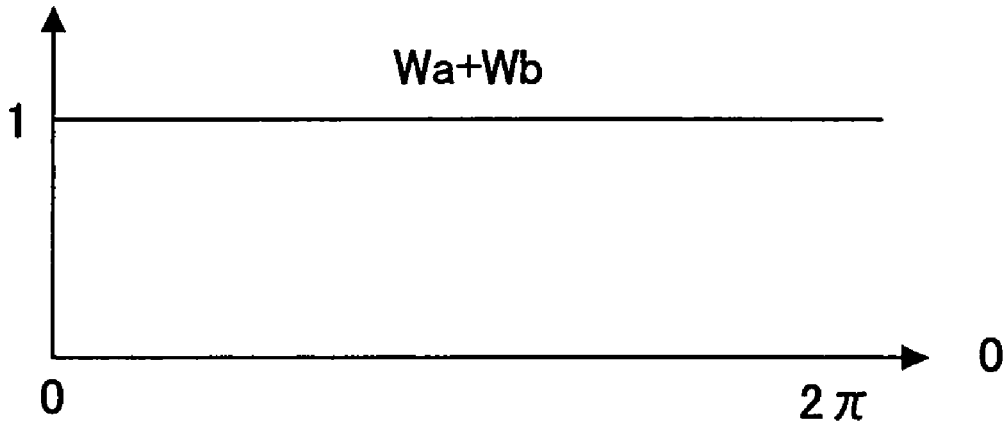
FIG. 13B is another diagram illustrating the change in the weightings on the first and second sensor outputs.

More specifically, the first sensor output from the first sensor 28A and the second sensor output from the second sensor 28B are weighted. This is described using FIGS. 12, 13A, and 13B. FIGS. 12, 13A, and 13B are diagrams for describing the principles of the process of weighting on the sensor outputs of each sensor 28A and 28B in the present embodiment.

In order to put the count value of the sensor output A back to the count value of the sensor output B, as illustrated in FIG. 12, the output from the first sensor 28A is weighted (the weighting coefficient here is set to be Wa) and the output from the second sensor 28B is also weighted (the weighting coefficient here is set to be Wb). The value of each weighting coefficient Wa and Wb as illustrated in FIG. 13A is set such that Wa decreases as the paper-carrying belt 22 (the linear scale 27) rotates and, conversely, Wb increases as the paper-carrying belt 22 (the linear scale 27) rotates. Then, the sum of each weighting coefficient Wa and Wb is set to be always constant as illustrated in FIG. 13B.

The weighting coefficients Wa and Wb are actually generated at the first corrector 51 illustrated in FIG. 11. Here the weighting coefficients Wa and Wb are values affected by the moving speed, etc., of the drive roller 24 (the paper-carrying belt 22) so that, as illustrated, the configuration is set such that rotating of the roller 24 (the paper-carrying belt 22) is detected from the rotating encoder 36 and the weighting coefficients Wa and Wb are obtained at the first corrector 51 based on the rotating detected.

Figure 9:
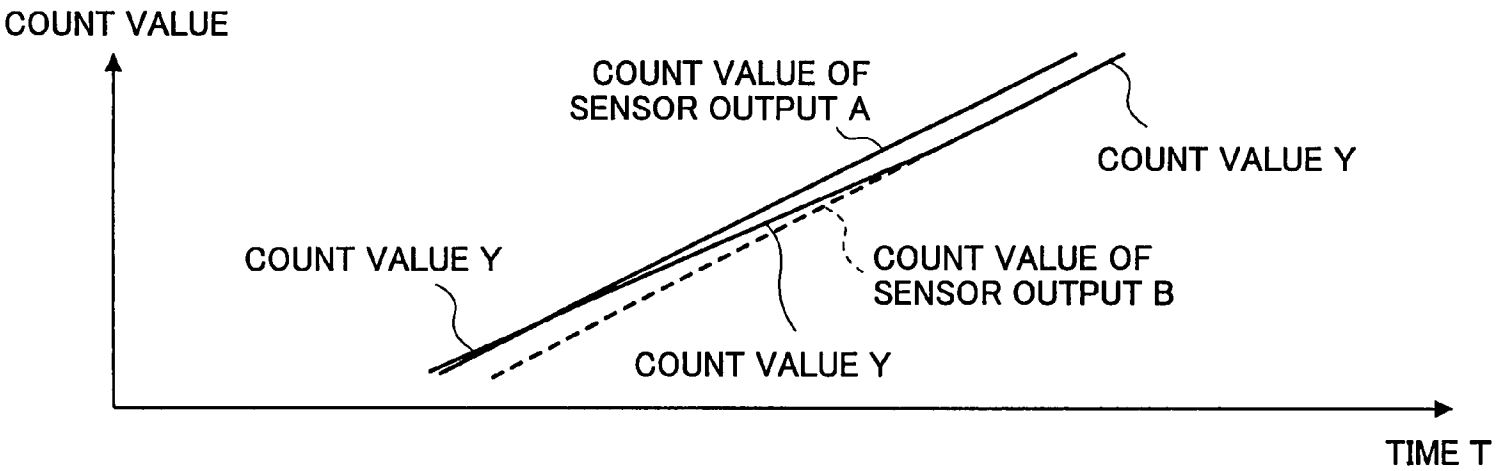
FIG. 9 is a second diagram for describing the process of switching the sensor output from the first sensor to the second sensor.

Thus, changing the weighting coefficients Wa and Wb based on the actual rotating state of the paper-carrying belt 22 and setting the weighting coefficients Wa and Wb to be reflected by the multipliers 47 and 48 in each counter value of the sensor outputs A and B make it possible to smoothly switch the sensor output from the first sensor 28A to the second sensor 28B while maintaining the phase continuity of the count value Y. FIG. 9 illustrates a change in the count value Y when changing the weighting coefficients Wa and Wb in order to switch the sensor output from the first sensor 28A to the second sensor 28B. As illustrated, according to the present embodiment, no changes are made in the count value Y in order to make it possible to switch smoothly.

On the other hand, gradually switching from the first sensor 28A to the second sensor 28B means that the detected position gradually moves from the position of the first sensor 28A to the position of the second sensor 28B. Thus, as the detected position moves in the same direction as the moving direction Y of the belt, the count value Y output from the detection apparatus 29 as it is ends up getting detected at a distance which is shorter than the actual distance moved of the paper-carrying belt 22.

For instance, assuming the distance separating the first sensor 28A and the second sensor 28B is 1 cm, and the belt length of the paper-carrying belt 22 is 30 cm, the distance over which the sensor scans the linear scale 27 becomes 29 cm relative to the movement of the paper-carrying belt 22 of 30 cm, resulting in detecting 29/30 of the distance moved of the belt. Thus, when performing signal processing, it is necessary to take this correction amount of 30/29 into account. The present embodiment is configured such that this correction is performed using the second corrector 52 as illustrated in FIG. 11. It is noted that, in another embodiment, a weighting-coefficient table may be prepared with the correction amount taken into account when preparing in advance the weighting-coefficient table, in which case the multiplying in the multiplier 49 as illustrated in FIG. 11 is not needed.

What is claimed is:

1. An image-forming apparatus, comprising:

a paper-carrying belt to carry paper;

a drive unit to driving the paper-carrying belt;

a scale provided on the paper-carrying belt to indicates position information and that includes a scale seam;

a position-detection unit to read the position information from the scale; and a control unit to generate position information from an output of the position-detection means and control the drive unit based on the position information in order to drive and control the paper-carrying belt;

wherein the position detection unit comprises a first sensor and a second sensor for reading the position information from the scale unit, and the first sensor and the second sensor separated by a distance which is more than or equal to a gap width of the scale seam; and wherein the control unit is operable to use as position information what is combined after putting weightings on a first sensor output which is output from the first sensor and a second sensor output which is output from the second sensor.

2. The image-forming apparatus as claimed in claim 1, wherein the first sensor and the second sensor are arranged such that the phases of the first sensor output and the second sensor output which are output when the scale seam is between the first sensor and the second sensor become the same.

3. The image-forming apparatus as claimed in claim 2, wherein the first sensor and the second sensor are configured such that an inter-sensor distance can be adjusted.

4. The image-forming apparatus as claimed in claim 1, wherein the control means performs the steps of:

instantaneously changing, when the scale seam moves to a position between the first sensor and the second sensor as said paper-carrying belt is carried, the weightings in order to switch a sensor output from the first sensor to the second sensor; and gradually changing, in a continuous portion of the scale after passing the scale seam, the weightings of the first and second sensor outputs in order to switch the sensor output from the second sensor to the first sensor.

5. The image-forming apparatus as claimed in claim 1, wherein the first sensor and the second sensor are provided at a position opposite the front face or at a position opposite the back face of the paper-carrying belt over which an ink head passes.

6. The image-forming apparatus as claimed in claim 1, wherein the scale seam is provided with a third sensor for detecting passing between the first sensor and the second sensor.

* * * * *